United States Patent [19]

Meshberg

[11] Patent Number: 4,457,455

[45] Date of Patent: Jul. 3, 1984

[54] COLLAPSIBLE CONTAINER

[76] Inventor: Philip Meshberg, 2500 S. Ocean Blvd., Palm Beach, Fla. 33480

[21] Appl. No.: 310,987

[22] Filed: Oct. 13, 1981

[51] Int. Cl.[3] ..... B65D 35/14

[52] U.S. Cl. ..... 222/105; 222/82; 222/183; 222/383

[58] Field of Search ..... 222/81, 82, 83, 89, 222/90, 92, 105, 107, 372, 380, 383, 384, 385, 321, 95, 129, 129.1, 129.2, 129.3, 129.4, 183; 220/404, 450

[56] References Cited

U.S. PATENT DOCUMENTS

| | | | |
|---|---|---|---|
| 2,715,980 | 8/1955 | Frick | 222/183 |
| 2,816,691 | 12/1957 | Ward | 222/183 |
| 3,039,648 | 6/1962 | Busch | 220/404 X |
| 3,240,394 | 3/1966 | Modderno | 222/95 |
| 3,285,461 | 11/1966 | Santelli | 220/404 |
| 3,412,900 | 11/1968 | Macaulay | 222/82 |
| 3,420,413 | 1/1969 | Corsette | 222/321 X |
| 3,478,935 | 11/1969 | Brooks | 222/321 |
| 3,655,096 | 4/1972 | Easter | 222/82 |
| 4,008,830 | 2/1977 | Meshberg | 222/95 |
| 4,077,549 | 3/1978 | Beard | 222/321 |
| 4,311,255 | 1/1982 | Meshberg | 222/183 |

*Primary Examiner*—Joseph J. Rolla
*Assistant Examiner*—Thomas Fitzgerald
*Attorney, Agent, or Firm*—Kenyon & Kenyon

[57] ABSTRACT

An improved collapsible container includes an outer rigid portion with a flange and a downwardly extending flexible bag portion so as to permit ease of filling, sealing and transport. Dispensing is done, preferably with a pump which, on first actuation, breaks the seal on the container. The pump, and a rigid outer container with which the collapsible container is used, are adapted for reuse with only the collapsible container and its contents replaced.

11 Claims, 9 Drawing Figures

COLLAPSIBLE CONTAINER

This invention relates to containers in general and more particularly to an improved collapsible container, particularly useful in combination with a non-vented pump.

In my previous U.S. Pat. Ser. No. 4,008,830, I disclosed the combination of a non-vented pump and collapsible container. Although the combination disclosed therein works quite well and offers numerous advantages, it suffers from drawbacks in that the arrangement is not adapted for reuse and in that various of the embodiments are not well adapted to filling on a conventional filling line. Furthermore, although hermetic sealing with the disclosed combination is possible, it is not easy to do. Also, the embodiment disclosed therein may not remain adequately sealed until the time when pumping first takes place, if there is any leakage in the pump. This can be a particular problem when it is desired to package a viscous foodstuff, for example. Other flexible containers for use with the pumps or the like suffer from similar disadvantages. For example one such device is disclosed in U.S. Pat. Ser. No. 3,420,413. This device does not adapt itself easily to filling on a conventional filling line and furthermore does not easily permit the type of hermetic sealing which is necessary when storing foodstuffs and the like. A similar disadvantage is suffered by the device shown in U.S. Pat. Ser. No. 3,223,289, which is adapted for use in a squeeze bottle type configuration. In addition, these prior art collapsible containers were not generally designed to facilitate reuse of parts such as the pump.

Thus, it is evident that there is a need for improved collapsible containers which permit ease of filling on a conventional filling line, and hermetic sealing until used, along with the maximum degree of reusability.

SUMMARY OF THE INVENTION

The present invention provides such a container. In accordance with the present invention, the collapsible container comprises an upper rigid portion including an essentially horizontally extending annular portion and, in the center thereof a neck. Extending downwardly from the rigid part, spaced somewhat inwardly from the circumference thereof so as to leave a flange, is a flexible collapsible bag portion. This particular construction offers numerous advantages. First of all, because of the flange in the upper rigid portion, support in a tool or an outer container, for filling on a conventional filling line by placing the flexible container in a suitable receptacle, supported by the flange, becomes possible. In most embodiments, no permanent rigid support is necessary during filling. Once filled, the filled container can be supported within a cardboard container or the like for delivery to the consumer. At the time of filling, it is a simple matter to seal off the opening in the neck of the upper rigid portion. This may be done in any of a number of ways, for example, with a foil or plastic thin seal, by means of a snap-on top or by means of a snap hinged top which is molded in one piece with the upper section.

It is prefered that the rigid upper portion and the flexible plastic bag be molded as a single unit through a combination of injection and blow molding. However, the two parts may be made separately and welded together. The consumer, who is using the product, which may be a foodstuff, such as catsup, mustard, mayonnaise or any one of a number of items, will have a rigid outer container. (The outer container and dispenser are purchased the first time he uses the product.) Upon buying the product within the flexible bag, he can then insert this into the container and screw the dispenser to be used with the container onto the opening. A pump is illustrated as the dispenser. However, this could also be a spout or, in some cases, one might wish to pour and could place a cap over the opening. The nature of one of the pumps disclosed is such that the seal is not broken until it is desired to start dispensing the material. This pump is of the general type disclosed aforementioned U.S. Pat. Nos. 4,008,830 and 3,221,346. That is to say, it is a pump in which the stem extends through the inlet opening at the inner end of the pump chamber to act as a valve. In a retracted position, the stem is more or less flush with the inner end of the pump chamber. The end of the stem is pointed, in accordance with the present invention so that, on the first actuation, the seal is broken permitting access of the material into the pump chamber. In this way, the container remains completely sealed until the first use. After first use, the pump seals the container in an efficient manner to avoid contamination.

In addition, an arrangement in which piercing of the seal takes place when the pump is inserted onto the container and the cap associated therewith screwed into place is also disclosed. In this embodiment a different type of pump is used.

In accordance with another illustrated feature, the pump can be operated by means of a trigger attachment of particularly efficient design in cases where large amounts of viscous material such as catsup are to be dispensed.

The container of the present invention is also particularly useful in conjunction with small dispensers such as are used for perfume and the like. In accordance with one embodiment, the flanged collapsible container is inserted in the neck of a outer rigid container prior to filling. The outer container can be of any material and need only to contain a vent therein. After filling, a pump is crimped onto the top of the container.

A particularly important application of this arrangement is for a perfume dispenser. In the prior art, perfume was normally contained in glass bottles because of incompatibility with metal cans. A further problem with perfume is the evaporation of the alcohol which is used in the perfume. The arrangement of the present invention avoids both these problems. First of all, the bag can be inserted within a metal rigid container and secondly a seal, such as a plug, can be placed in the opening of the rigid portion of the container after filling. The pump is crimped on, and, once again, the plug will not be dislodged or the seal will not be pierced until the first stroke of the pump thereby avoiding evaporation until ready for use. This, of course, greatly extends shelf life.

BRIEF DESCRIPTION OF THE DRAWINGS

FIG. 6 is a cross-sectional view of a container particularly useful for containing and dispensing perfume or the like.

DETAILED DESCRIPTION OF THE INVENTION

Figure 1:
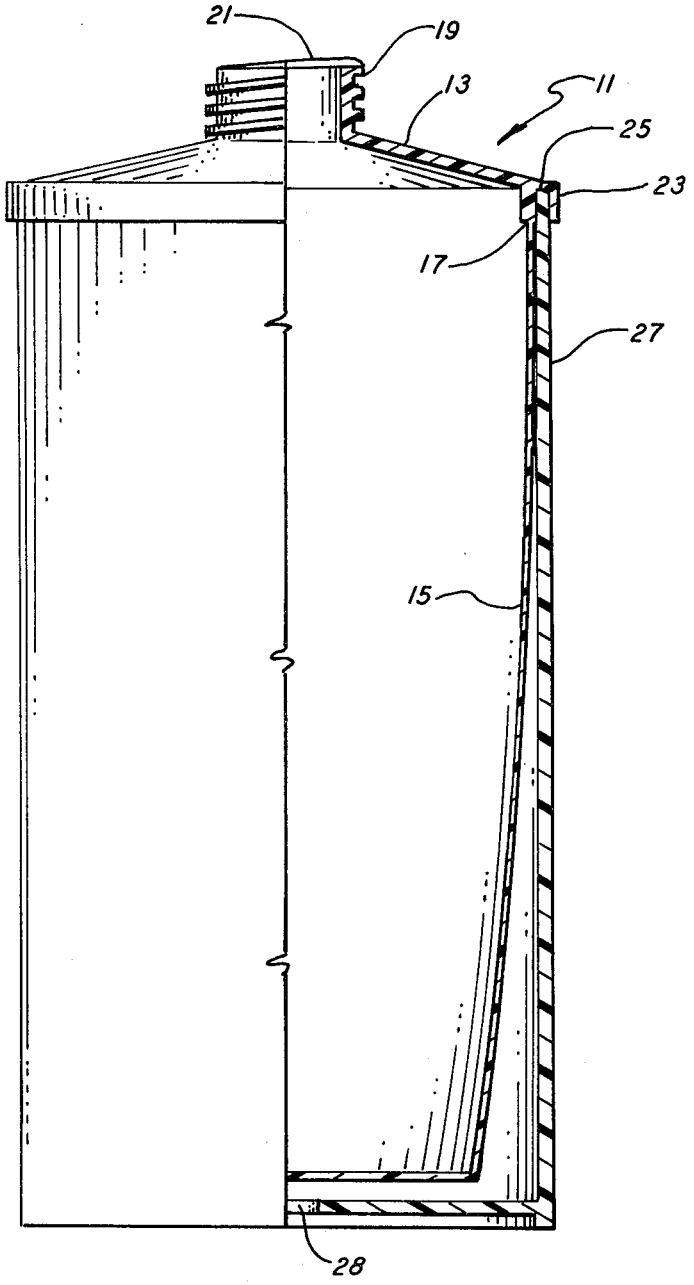
FIG. 1 is a cross-sectional view of a first embodiment of the present invention.

FIG. 1 illustrates a first embodiment of the present invention. The container shown in FIG. 1, and designated generally as 11, includes an inner container with a rigid top 13 and a flexible bag portion 15. The flexible bag portion is attached to the rigid top 13 at a point 17. Preferably, this is accomplished by means of a combined injection and blow molding operation. However, a weld may be provided at point 17. In the embodiment of FIG. 1, rigid portion 13 is essentially frustroconical with a threaded neck 19 to permit attachment of a pump or other dispenser to the container. Also shown is a seal 21 over the top of the container which may be of foil, thin plastic or the like. The rigid top portion 13 has an extending flange section 23 which, in this embodiment, contains a circular slot 25. Inserted into the the slot 25 is the upper end of a rigid outer container 27 of generally hollow cylindrical shape. A container of this nature can be filled in the condition shown or, prior to assembling the rigid top 13 onto the outer rigid container 27, in a manner to be more fully described below in connection with FIGS. 2 and 3. The container can be sold in the condition indicated but, if there is a danger of accidental puncture of the seal 21, could be sold with a cap. The user, after purchasing such a container, either with or without the outer case (if he already had a case then he need only buy the inner portion and can use his old case) will screw a pump or other dispenser onto the threads 19 and will puncture the seal, preferably with the pump, in a manner to be described below, to commence dispensing. The outer container can, of course, be of any material of sufficient structural strength. Thus, it can be paper or cardboard, plastic, metal, etc. It includes a vent hole 28 for permitting atmospheric pressure to act on inner container 15.

Figure 2:
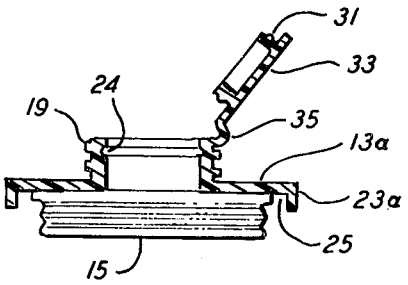
FIG. 2 is a cross-sectional view of a second embodiment of the present invention showing the container in the collapsed condition.
Figure 3B:
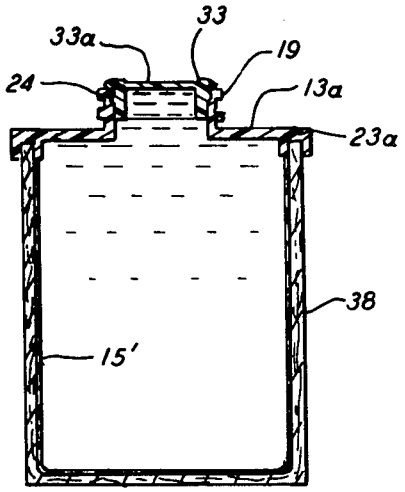
FIGS. 3*a* and 3*b* are views of an embodiment similar to that of FIG. 2 in the filled condition, in the filling fixture and a cardboard outer container, respectively.
Figure 3A:
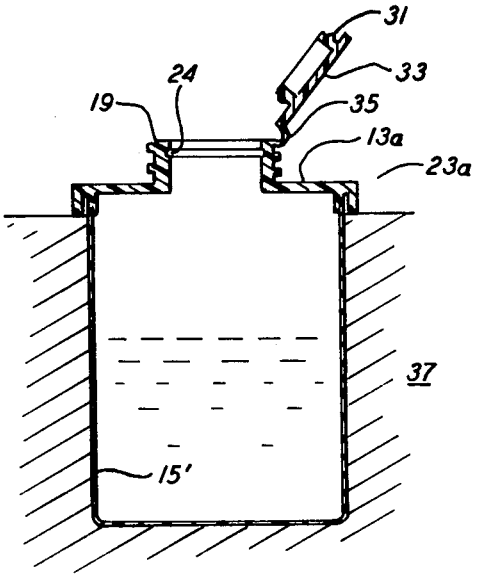

FIG. 2 illustrates another embodiment of the present invention. The construction is quite similar to that previously described in connection with FIG. 1. In this embodiment, the rigid top **13*a* is disc-like rather than frustroconical. The threaded neck 19 is similar to that of FIG. 1 with the exception that it includes a recess 29 on its inside. This recess mates with a projection 31 on a cap 33 to seal off the top of the container. This seal can be insured further by plastic welding or through use of a bonding agent. In the illustrated embodiment, the cap 33 is connected to the neck 19 by means of a hinge 35. The cap 33** could equally well be a separate piece (See FIG. 3*b*). The flexible bag portion 15 is shown collapsed. It should be noted that it takes up much less space than the filled container. This is one of the advantages of using such containers, since they can be shipped to the filling location in a collapsed condition taking up little space. A flange 23 forming a slot 25 is provided at the edge of the rigid top part **13*a***. As shown in FIG. 3*a*, this permits the container to rest within a recess formed in a filling fixture 37 which is placed on the filling line. As the container 15 is filled with material, it fills out, taking the shape shown in FIG. 3*a*. The filled container, after being removed from the tool, and inserted in another container 38 of cardboard, for example, is illustrated in FIG. 3*b*. A cap **33*a***, without a hinge, is now in place preferably hermetically sealed. This can be done using conventional techniques. If necessary any sterilizing, pasturizing, irradiating or the like which must take place in order prevent deterioration of the contents can now be carried out. The filled package of Fig. 3*a* can be inserted in an inexpensive cardboard carton 38 or the like for shipping to the consumer. Again, upon receipt, the consumer can insert this package into a stronger rigid container such as plastic which he already has and then screw a pump or other dispenser onto the container.

Figure 4A:
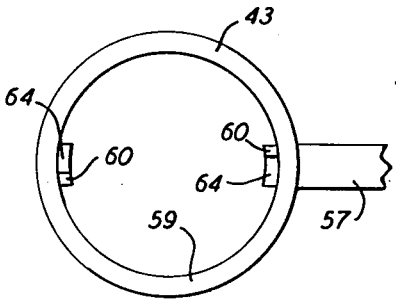
FIG. 4A is a cross section through FIG. 4.
Figure 4:
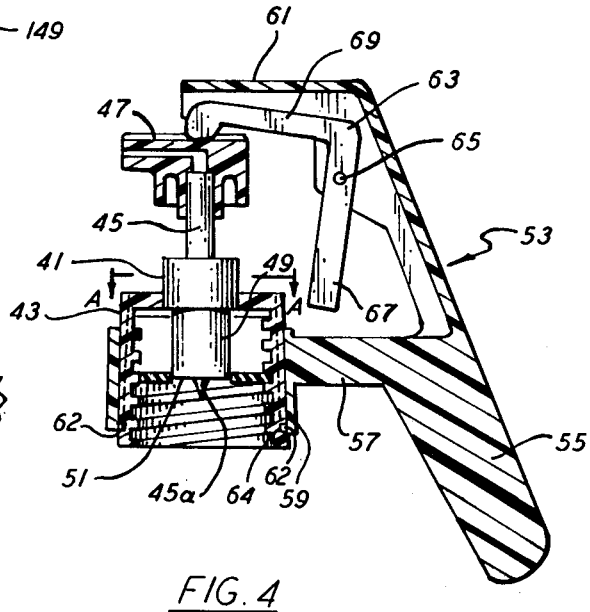
FIG. 4 illustrates a pump with a trigger attachment which can be used with the container of FIGS. 1, 2 and 3.

A pump that can be used for this purpose is illustrated in FIG. 4.

The pump is of the nature disclosed in my U.S. Pat. Ser. No. 3,211,346 with the exception that there need not be a projecting portion to which a dip tube is attached. The pump terminates at the bottom of or inner end of the pump chamber. Furthermore, the pump described in U.S. Pat. No. 4,274,560, which is a prepressurized pump may also be used. The key characteristic of all of these pumps is that they have a dispensing stem which, when depressed, projects through an inlet opening at the inner end of the pump, to act as a valve at the inlet to the pump chamber. In each case, the pump is also a non-vented pump. The outer container is vented so that atmospheric pressure acts on the thin bag portion 15 or 15'. As material is dispensed from the pump chamber and a partial vacuum created on a return stroke, this pressure, through the bag, refills the chamber. The bag 15 partially collapses to make up for the removed material.

Thus, shown on FIG. 4 is a pump 41 which is contained within a cap 43, the cap preferably having a slight taper, i.e., being slightly frustroconical. The pump includes an extending stem 45 on the end of which is located an actuator 47 from which the material to be dispensed is ejected. The pump chamber 49 has an opening at its inner end through which the pump stem 45 projects with a pointed end **45*a*. This is shown slightly extended. However, in the normal, at rest position, the stem is slightly recessed. The cap 43** is screwed onto a container of FIG. 1 or 3*b*, in a sealing manner so that the inner end 51 of the pump chamber 49 is essentially in abutment with the seal 33, for instance. When the stem 45 is pressed down by pressing on the actuator 47, the pointed end 45 will pierce the seal which, for example, in the embodiment of FIG. 3*b* has a thin plastic section **33*a*** in its central area, to bring the material to the inlet to the pump chamber. On the outward stroke because of the partial vacuum created within the pump chamber, material will be drawn in and be ready for dispensing on the next stroke.

The pump, where small amounts of a material which is not particularly viscous are to be dispensed, need include only the elements just described. Where the pump is larger and/or more viscous materials must be dispensed, a greater mechanical advantage is required. For this purpose, a trigger spray is preferable. Illustrated in FIG. 4 is an attachment 53 which converts the normal axial motion, finger operated pump to a trigger spray pump. Included is a pistol grip handle 55 having extending therefrom an arm 57 on the end of which is a hollow cylindrical portion 59 with a diameter matched to that of the cap 45. This part slips over the cap 45 and, because of the taper of the cap 45, will end up with a press fit thereon. To further insure secure mounting, cap 45 contains vertically extending grooves 60 into which tabs 62 on portion 59 fit (See Fig. 4A). At the inner end of grooves 60 are horizontal slots 64 into which tabs 62 are rotated to lock the trigger attachment in place. The pistol grip continues to extend upwardly and has another arm extending to a position above the actuator 47. A right angle member 63 is hinged to the handle 55 by a pin 65 intermediate the arms 57 and 61. It includes one leg 67 which forms a trigger. The other leg 69 contacts the top of the actuator 47, preferbly fitting in a groove formed therein to fix the direction. Pulling the trigger 67 towards the pistol grip 55 will move the actuator and thus the stem inwardly to carry out the pumping action. Preferably, the pistol grip handle 55 will have a "U" cross-section above arm 57 with right angle member 63 disposed between the legs of the "U".

Figure 5:
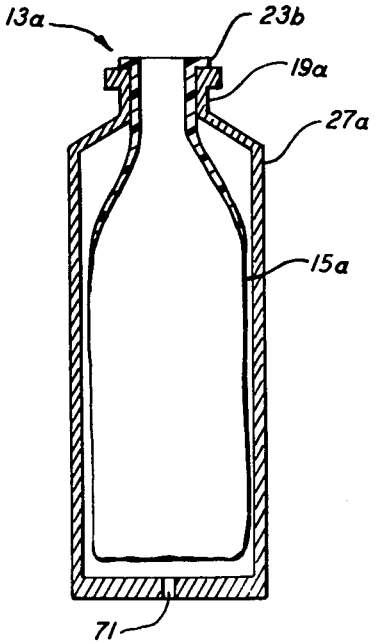
FIG. 5 illustrates an embodiment of a container of the present invention particularly adapted for dispensing small quantities of a material with a pump crimped, rather than screwed onto it.

FIG. 5 illustrates another embodiment of the present invention. In this embodiment, the rigid upper portion again includes a flange **23*b*. In this case, it does not have an outwardly, but rather an inwardly extending neck portion 19*a*. Again, extending downwardly from the rigid portion 13*a* is the flexible bag 15*a*. The container is shown disposed within an outer rigid container 27*a* which may be made of any material such as plastic, glass or metal. It need only include a vent 71 to permit access of air. The embodiment of FIG. 5** is shown in a filling configuration.

Figure 6:
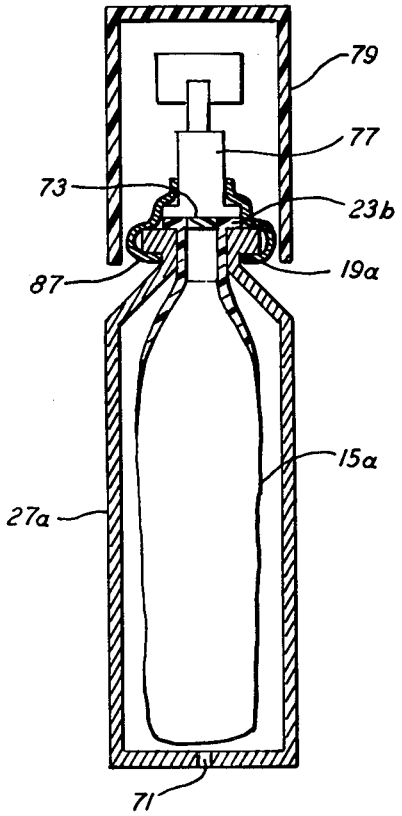

FIG. 6 shows an embodiment of this nature after being filled. This embodiment is particularly useful with perfumes. With perfumes, there is first of all a problem with evaporation and second of all a problem of incompatibility with metal containers. Thus, until now, perfume has usually been contained in glass containers which can be dangerous if broken and are more expensive. Thus, in the embodiment of FIG. 6, the outer container **15*a* is made of metal. Plastic could also be used. After the inner bag 15*a* with its rigid neck portion 19*a* and flange 23*b* is filled with perfume, a plug 73, of plastic or the like, is inserted in the opening in the neck 19*a* to seal the contents. Rather than a plug, a seal of some other nature such as foil may be used. Thereafter, a pump 77 of the general nature described above is crimped onto the container in conventional fashion by means of a mounting cup 87. Again, the pump does not include a dip tube or any extension for a dip tube. And its actuating stem is used to pierce or dislodge the seal. The pump is essentially the type of pump shown in FIG. 4 except that it is adapted to be crimped on rather than screwed on. A protective cover of plastic or the like, 79 can then be placed over the pump portion. The cover, along with the can will be made decorative in any desired manner. The contents remain sealed until it is time for use, i.e., until the first actuation of the actuator 47**. In this way, the chance of any evaporation of the perfume during storage is greatly minimumized.

Figure 7:
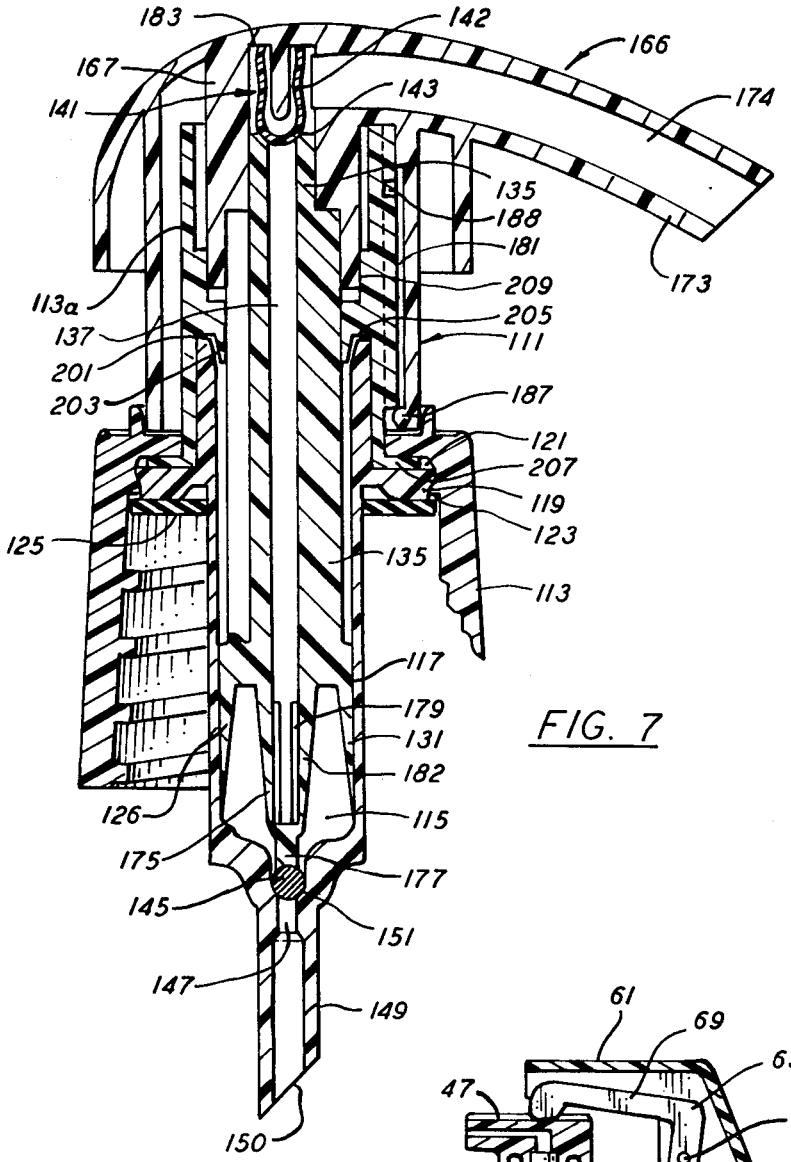
FIG. 7 is a view of a pump having a tail piece which is pointed for piercing a sealed collapsible container.

FIG. 7 illustrates another pump which may be used with the present invention. This embodiment includes a threaded cap 113, which is screwed onto the neck 19 of Fig. 1 for example. A pump 111 is provided. Pump 111 is of the type having check valves at the inlet and outlet of a pump chamber 115 within a pump body 117. The pump body 117 includes a flange 119 near its upper end. Flange 119 is sealed into a recess 121 in cap 113 where its snaps behind a bead 123. Thus, there is an air-tight seal between the recess 121 formed in the neck 113 and the flange 119. This, along with a gasket 125 seals off the portion of the container therebelow from the top. In this embodiment, the inlet to the pump chamber 115 contains a ball check valve with a seat 151 and ball 145 closing off the passage 147 into the chamber 115. The pump includes a piston 126 mounted for reciprocal motion in the pump chamber 117. The piston has a lower flange 131 which contacts the wall of the pump chamber 117. Extending from the top of the flanged portion of the piston is an integral stem assembly 135 containing a dispensing passage 137. A projection 175 extends downwardly from the piston 126. On the bottom is a projecting part 177 which, in the fully inward position shown, holds the ball 145 in place. Within the downwardly projecting part 175 is a channel 179. The inlet of channel 179 is through slotted portions 182 which are within the pump chamber 117. The outlet of the channel 179 opens into the passage 137 which is closed off by a check valve 141. Although a normal ball check valve could be installed at this point, a type of plastic check valve is utilized in the illustrated embodiment. The check valve has outer portions 142 of tortuous shape and an inner semi-spherical portion 143 attached thereto. The valve is molded in one piece. Because of the flexibility of the plastic, when pressure is build up in the pump chamber the portions 142 act as springs and the spherical cylindrical portion 143 will become unseated and flow will be established through the valve into a passageway 174 in the actuator spout 173.

The actuator 166 has an inner central cylindrical portion 167 into which the actuator stem 135 fits with a press fit. Valve 141 is retained in a recess 183 in the actuator 166 extending downwardly to the valve seat at the end of the actuator channel 137. Spout 173 is adapted for dispensing thick liquids such as soap, shampoo and the like.

In order to permit locking in the inward position, there is a cylindrical member **113*a*. Member 113*a* is a generally cylindrical part with an inwardly extending flange therein from which there is, extending inwardly toward the pump chamber, an annular part 203 with a somewhat frustroconical shape. The upper portion of the pump body 115 above the flange 119 fits into the annular channel 205 which is formed between the annular part 203 and the wall of the cylindrical part 113*a*. At the bottom of the cylindrical part 113*a* is an outwardly extending flange 207 which fits into an appropriate recess behind flange 119 which then holds it against the cap 113** at the opening.

On the outside of the cylindrical part **113*a* is a rounded bulge 181. A projection or nib 187 on the inside of the actuator 166 is free to move up and down along side bulge 181. Rotation when in the outward position will cause the actuator to be locked in that position because of the nib 187 abutting against a slot 188 in the bulge at the top of the cylindrical part 113*a*. When guided downward to the bottom and then rotated, the nib 187 locks beneath the bulge 181 and the actuator becomes locked in the fully inward position. In this position, as illustrated by FIG. 7, the projection 175, at its end 177, is in contact with the ball 145 holding the check valve at the inlet to the chamber closed. In addition, an outwardly bevelled portion 209 of the inner part 167 of the actuator will be against the inner wall of the cylindrical part 13***a* there creating an additional seal. In this case, the container, including outer rigid container of FIG. 1, with the pump 111 and also with the actuator 163, can be pre-assembled, preferably with the actuator locked in its fully inward position shown in Fig. 7, and shipped to the supplier who will then fill the containers and place the pump on the container.

Because of the flexible inner containter, there is no need for a dip tube nor is there any need for means to prevent the flexible container from collapsing around the dip tube as was required in my aforementioned U.S. Pat. No. 4,008,830. Furthermore, this dispenser has the advantage of being able to dispense in any position, even upside down, something which a conventional dispenser utilizing a bottle and dip tube will not do.

The ability to lock the piston in a fully inward position is of particular importance in an embodiment such as this. Beyond the fact that it reduces the overall size, it insures that the pump will be primed when first used.

The pump also includes a pointed end 150 on tail piece 149 for puncturing the seal such as the seal 21 of the container of FIG. 1 when being inserted onto a refill, for example.

What is claimed is:

1. An improved container for dispensing a liquid comprising:

a. an outer container in the form of a solid bottle having a neck portion adapted for receiving mounting means, said outer container having a vent opening therein;

b. an inner flexible container comprising a rigid outer portion having an axially inwardly extending neck and a radially outwardly extending flange inserted in said outer container with said flange resting on said neck portion of said bottle, and an inner flexible portion disposed inside the body of said bottle, said bag filled with the material to be dispensed;

c. means sealing the opening of the neck of said rigid outer portion thereby sealing said inner container;

d. a pump, said pump having a pump chamber terminating at an inner wall and an opening in said inner wall through which an axially actuated stem extends; and e. mounting means containing said pump said mounting means attached to the neck of said bottle with the inner end of said pump essentially in contact with said means sealing, a dispensing stem coupled to said axially actuted stem, projecting outwardly from said mounting means, whereby until said dispensing stem is first actuated, said container will remain sealed and, upon actuation said stem will open said seal to permit dispensing from said pump.

2. In the combination of a nonvented pump of the type having an inner stem part extending through a chamber at the inner end of the pump, and an outer stem part extending outwardly to permit actuation, upon actuation of said outer stem part, said inner stem part moving through an opening at the inner end of said chamber; a rigid outer container; an inner collapsible container which can be replaced, to provide a refill, having a seal over the end thereof, and means for attaching said nonvented pump to said container such as to bring the inlet of said pump into communication with the contents within said collapsible container, the improvement comprising a pointed end on the inner stem part of said pump for piercing the seal of said collapsible inner container.

3. A collapsible container which is adapted to be filled and transported without the need for a rigid supporting outer container and which is adapted for use with a pump or other dispenser comprising:

a. a rigid top portion of generally annular shape including an axially extending central neck portion with an opening therein, and an outwardly extending flange portion;

b. a flexible bag extending axially inwardly from said rigid portion, radially inward of said flange whereby said flange can be rested on a solid support during filling;

c. a seal sealing off said opening in said neck;

d. a pump disposed in mounting means, said mounting means mounted onto said neck, said pump including a pump chamber terminating in an inner wall having an inlet opening therein, and a dispensing stem extending through said pump chamber to said opening, said dispensing stem being pointed at its inner end, said inner end of said chamber being disposed adjacent said seal, whereby, upon actuation of said pump stem, said seal will be broken to permit dispensing;

e. an actuator on the axial outer end of said dispensing stem; and f. a trigger spray attachment to convert radial motion to axial motion attached to said mounting means and pump and operably connected to said actuator to convert a radial movement by an operator into axial movement of said actuator including:

i. a pistol grip handle;

ii. a first arm extending from said pistol grip handle having on the end thereof a hollow cylindrical member, said cylindrical member surrounding and in close abutment with said mounting means;

iii. a second arm extending from said pistol grip to a location above said actuator; and iv. a 90° angular portion hinged to said pistol grip intermediate said first and second arms having a first leg contacting said actuator and a second leg spaced from said piston grip when said actuator is full outward, whereby movement of said second leg toward said pistol grip will act to move said actuator inwardly.

4. The container according to claim 3 wherein said actuator contains a groove on its top for locating said first leg.

5. The container of claim 3, wherein said neck portion contains thereon screw threads and wherein said mounting means comprise a threaded cap screwed onto said threads on said neck.

6. An improved container for perfume and the like comprising:

a. an outer container having a neck portion adapted for receiving a mounting cup, said outer container containing a vent opening therein;

b. an inner flexible container comprising a rigid outer portion, having an axially inwardly extending neck and a radially outwardly extending flange inserted in said outer container with said flange resting on the neck portion of said outer container, and an inner flexible portion disposed inside the body of said outer container, said bag filled with the material to be dispensed;

c. means sealing the opening of the neck of said rigid outer portion thereby sealing said inner container;

d. a pump, said pump having a pump chamber terminating at an inner wall, and an opening in said inner wall through which an axially actuated valving stem extends when operated; and e. a mounting cup containing said pump, said mounting cup crimped to the neck of said outer container with inner end of said pump essentially in contact with the said means sealing, an actuating and dispensing stem projecting outwardly from said mounting cup, whereby until said pump is first actuated, said container will remain sealed and, upon actuation, said valving stem will open said seal to permit dispensing from said pump.

7. The container according to claim 6 wherein said means sealing comprise a plug inserted in said opening.

8. The container according to claim 6, wherein said outer container comprises a metal bottle.

9. A trigger spray attachment for a pump having an axially movable actuator, said pump supported in a cap having a cylindrical shape for mounting it to a container, comprising:

a. a pistol grip handle;

b. a first arm extending from said pistol grip having on the end thereof a hollow cylindrical member, said cylindrical member surrounding and in close abutment with said cap;

c a second arm extending from said pistol grip to a location above said actuator; and d. a 90° angular portion hinged to said pistol grip intermediate said first and second arms having a first leg contacting said actuator and a second leg spaced from said pistol grip when said actuator is fully outward, whereby movement of said second leg toward said pistol grip will act to move said actuator inwardly.

10. The trigger spray attachment according to claim 9 wherein said actuator contains a groove on its top for locating said first leg.

11. The trigger spray attachment according to claim 10 and further including cooperating portions of said cap and hollow cylindrical member for locking said attachment to said cap.

* * * * *